US006652395B2

(12) United States Patent
Goldwitz

(10) Patent No.: US 6,652,395 B2
(45) Date of Patent: Nov. 25, 2003

(54) COLLAPSIBLE SPORTS GOAL ASSEMBLY

(75) Inventor: Brian L. Goldwitz, Orange, CT (US)

(73) Assignee: Tracy Goldwitz, Orange, CT (US)

( * ) Notice: Subject to any disclaimer, the term of this patent is extended or adjusted under 35 U.S.C. 154(b) by 0 days.

(21) Appl. No.: 10/223,887

(22) Filed: Aug. 19, 2002

(65) Prior Publication Data

US 2002/0193189 A1 Dec. 19, 2002

Related U.S. Application Data

(63) Continuation of application No. 09/612,711, filed on Jul. 10, 2000.

(60) Provisional application No. 60/143,332, filed on Jul. 8, 1999.

(51) Int. Cl.[7] ..... A63B 63/00

(52) U.S. Cl. ..... 473/478; 473/476

(58) Field of Search ..... 473/478, 446, 473/416, 476; 273/400; 280/87.041; 297/184.15

(56) References Cited

U.S. PATENT DOCUMENTS

| | | | | |
|---|---|---|---|---|
| 5,080,375 | A | | 1/1992 | Moosavi |
| 5,186,469 | A | | 2/1993 | Terris |
| 5,431,411 | A | | 7/1995 | Padilla |
| 5,533,733 | A | | 7/1996 | Dirnbeck |
| 5,539,957 | A | | 7/1996 | Schmidt |
| 5,634,638 | A | * | 6/1997 | Havens et al. ..... 473/421 |
| 5,655,774 | A | | 8/1997 | Cox |
| 5,681,045 | A | | 10/1997 | Liao |
| 5,690,339 | A | | 11/1997 | Chen |
| 5,695,195 | A | | 12/1997 | John et al. |
| 5,830,089 | A | | 11/1998 | Halter et al. |
| 5,839,733 | A | | 11/1998 | Meeks et al. |
| 5,902,195 | A | | 5/1999 | Pavonetti |
| 5,902,196 | A | | 5/1999 | Chorneyko |
| 6,113,507 | A | | 9/2000 | Padilla |

* cited by examiner

*Primary Examiner*—Paul T. Sewell
*Assistant Examiner*—M. Chambers
(74) *Attorney, Agent, or Firm*—Edwards & Angell, LLP; George N. Chaclas, Esq.

(57) ABSTRACT

A collapsible sports goal assembly movable between an open position and a closed position has a base frame, a front frame, and a top frame, and one or more connecting leg assemblies to provide support for the goal assembly. The base frame, the front frame, and the top frame respectively include a first leg, a second leg laterally spaced relative to the first leg and oriented approximately parallel thereto, and a third leg extending between the first and second legs. The first leg of the front frame is pivotally connected to the first leg of the base frame, and the second leg of the front frame is pivotally connected to the second leg of the base frame thereby pivotally connecting the front frame to the base frame. The first and second legs of the top frame are pivotally connected to the third leg of the front frame to thereby pivotally connect the top frame to the front frame. A connecting leg assembly is pivotally connected at one end to the base frame and pivotally connected at another end to one of the front frame and top frame, and includes a male leg slidably received within a female leg. In the open position, the base frame and front frame are oriented approximately perpendicular to each other, and the top frame extends laterally and rearwardly from the front frame and is spaced above the base frame. The connecting leg assembly extends upwardly and forwardly from the base frame and is pivotally connected to either the top frame or the front frame. A releasable locking member is located in the locked position to thereby fixedly secure the position of the male leg relative to the female leg and, in turn, fixedly secure the base frame, front frame and top frame in the open position.

18 Claims, 17 Drawing Sheets

COLLAPSIBLE SPORTS GOAL ASSEMBLY

RELATED APPLICATIONS

This application claims the benefit of U.S. Provisional Patent Application Serial No. 60/143,332 filed Jul. 8, 1999 and is a continuation of U.S. patent application Ser. No. 09/612,711 filed Jul. 10, 2000, both of Brian L. Goldwitz, the disclosures of which are herein incorporated by reference.

FIELD OF THE INVENTION

The present invention relates to sports goal assemblies. More particularly, the present invention relates to a collapsible sports goal assembly that forms a fully assembled position for use as a temporary or seasonal sports goal, and a flat, collapsed position to permit easy transfer and storage.

BACKGROUND INFORMATION

Collapsible sports goals are known in the prior art. For example, U.S. Pat. No. 5,830,089 to Halter et al. ("the '089 patent") shows a collapsible sports frame assembly with a net that is extended around the frame. The '089 patent further shows a rectangular base frame, inverted u-shaped goal and rear frames, and interlocking detent and notch formations for releasably locking the frame in an open position. The '089 patent also shows a ramp mounted on the base frame for guiding a ball upwardly over the front frame member of the base frame into the goal.

One drawback associated with this prior art goal frame is the obstruction of entry into the goal frame. Another drawback associated with this and other prior art collapsible goal frame assemblies is the difficulty in ensuring that the netted covering does not sag into the front goal opening thereby further obstructing entry of an object into the goal frame, and/or interfering with movement of a player positioned within the opening of the goal frame.

Accordingly, it is an object of the present invention to overcome these and other drawbacks and disadvantages of the prior art.

SUMMARY OF THE INVENTION

The present invention is directed to a collapsible sports goal assembly including a base frame, a front frame, and a top frame. The base frame, the front frame, and the top frame respectively include a first leg, a second leg laterally spaced relative to the first leg and oriented approximately parallel thereto, and a third leg extending between the first and second legs. The first leg of the front frame is pivotally connected to the first leg of the base frame, and the second leg of the front frame is pivotally connected to the second leg of the base frame to thereby pivotally connect the front frame to the base frame. The first and second legs of the top frame are pivotally connected to the third leg of the front frame to thereby pivotally connect the top frame to the front frame.

The collapsible sports goal assembly of the present invention further includes at least one connecting leg assembly pivotally connected at one end to the base frame and pivotally connected at another end to either the front frame or the top frame. The connecting leg assembly includes a female leg, and a male leg slidably received within the female leg. The connecting leg assembly further includes at least one releasable locking member movable between a locked position with the locking member extending between the male and female legs and fixedly securing the male and female legs relative to each other, and an unlocked position spaced away from at least one of the male and female legs to thereby allow the male and female legs to slidably move relative to each other.

The base frame, front frame, top frame and at least one connecting leg assembly are movable between an open position and a closed position. In the open position, the base frame and front frame are oriented approximately perpendicular to each other, and the top frame extends laterally and rearwardly from the front frame and is spaced above the base frame. The one connecting leg assembly extends upwardly and forwardly from the base frame and is pivotally connected to either the top frame or the front frame. The one releasable locking member is located in the locked position to thereby fixedly secure the position of the male leg relative to the respective female leg and, in turn, fixedly securing the base frame, front frame and top frame in the open position. In the closed position, the releasable locking member is located in the unlocked position, at least one of the base frame and front frame is folded onto the other, and the top frame is oriented approximately parallel to at least one of the front and base frames to thereby place the frame assembly in an approximately flat, collapsed condition.

One advantage of the present invention is that the goal assembly provides a versatile collapsible sports goal assembly with unobstructed entry into the goal. Another advantage of the present invention is that the top frame provides additional support for a netted enclosure to ensure unobstructed entry into the goal as well as provide easy access to retrieve objects that have entered the goal.

Other objects and advantages of the sports goal assembly of the present invention will become apparent in view of the following detailed description of the preferred embodiments and accompanying drawings.

DETAILED DESCRIPTION OF THE PREFERRED EMBODIMENTS

Figure 1:
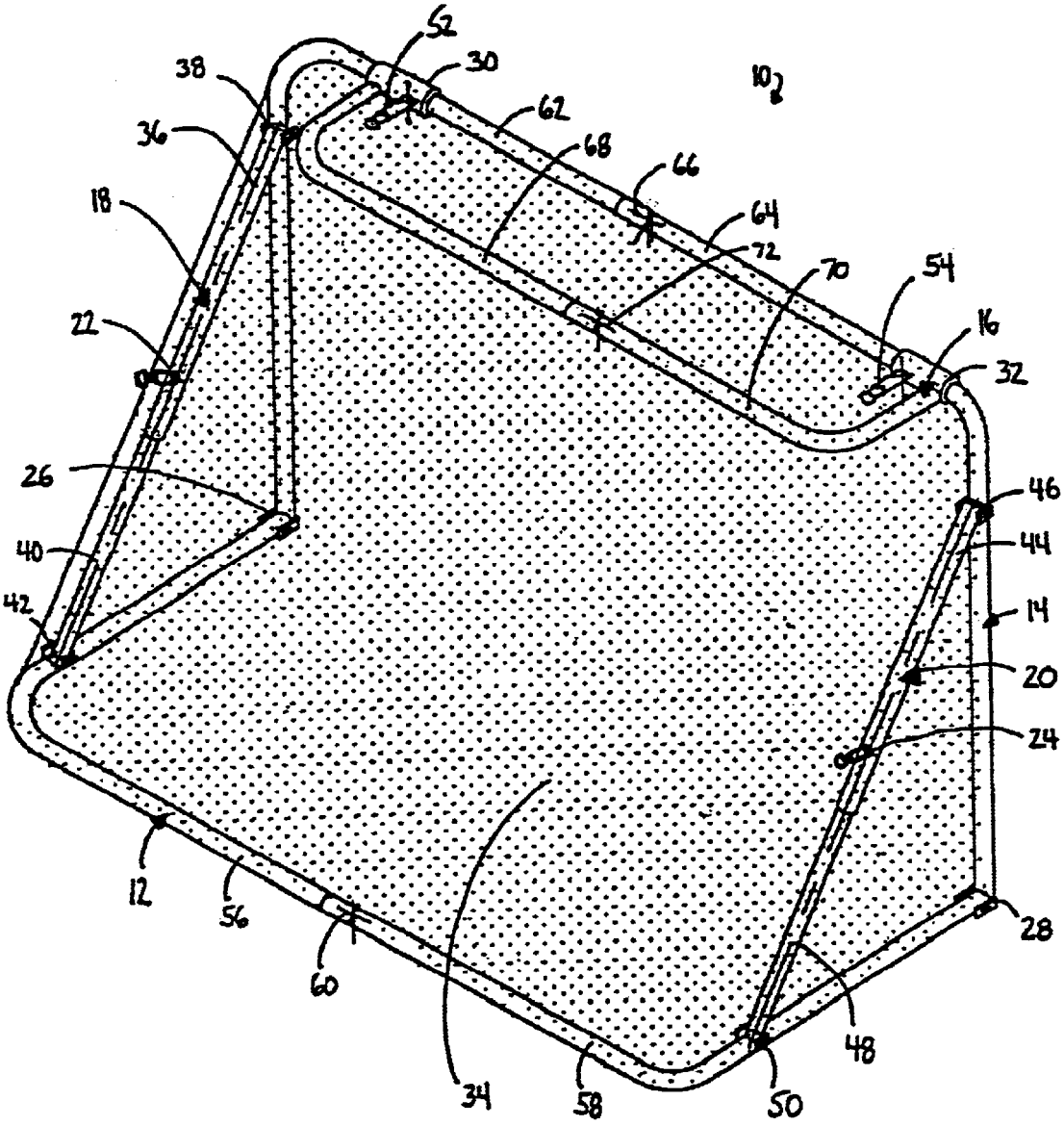
FIG. 1 is a top rear isometric view of a collapsible sports goal assembly of the present invention in an open condition.
Figure 2:
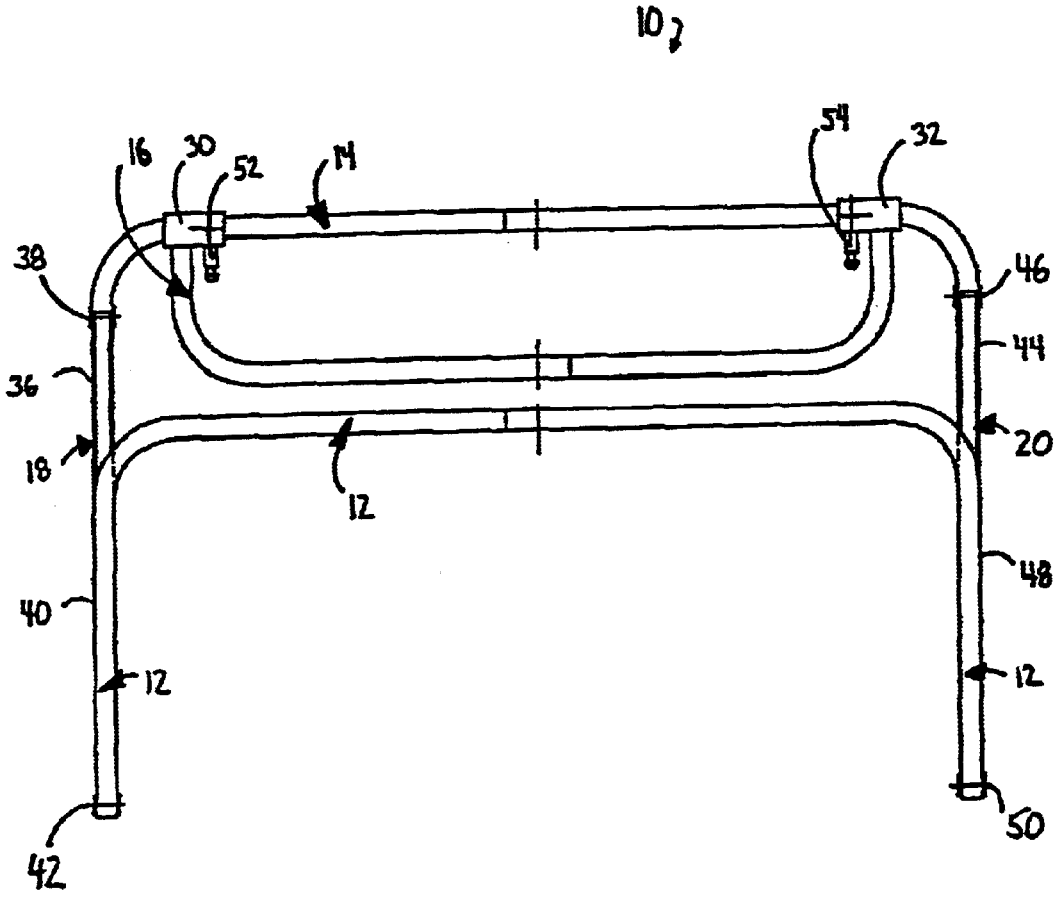
FIG. 2 is a rear elevational view of the collapsible sports goal assembly of FIG. 1 in a closed condition.

As shown in FIG. 1, a collapsible sports goal assembly 10 of the present invention comprises a base frame 12, a front frame 14, a top frame 16, and two connecting leg assemblies 18 and 20 including releasable locking members 22 and 24, respectively. As can be seen, each of the base frame 12, front frame 14, and top frame 16 includes a first leg, a second leg laterally spaced relative to the first leg and approximately parallel thereto, and a third leg extending between the first and second leg to thereby define three approximately unshaped frames. As described further below, the respective frames and connecting leg assemblies are pivotally connected to each other such that the assembly 10 can be oriented in the assembled open position as shown in FIG. 1, or in a collapsed and relatively flat position for transfer and storage, as shown in FIG. 2.

The base frame 12 is connected to the front frame 14 at the pivot joints 26 and 28. Thus, the base frame 12 and the front frame 14 can be rotated in relation to each other at pivot joints 26 and 28, from a relatively flat or collapsed position as shown in FIG. 2, to an open position with the front and base frames approximately perpendicular to each other, as shown in FIG. 1. When in use as a sports goal, the base frame 12 typically rests on the surface of play. In turn, the front frame 14 is oriented in a position approximately perpendicular to the base frame 12 such that the front frame 14 extends upwardly from the surface of play to form the goal periphery.

As further shown in FIG. 1, the front frame 14 is connected to the top frame 16 at pivot joints 30 and 32. Thus, the front frame 14 and the top frame 16 can be rotated in relation to each other at the pivot joints 30 and 32, from a relatively flat or collapsed position, as shown in FIG. 2, to an open position approximately perpendicular to each other, as shown in FIG. 1. In the fully assembled position of FIG. 1, the top frame 16 is oriented in a position extending laterally and rearwardly from the front frame 14. In this position, the top frame 16 can support additional goal structure, such as a net 34, and provides head and/or shoulder room for a player positioned within the opening of the goal, such as a goalie.

In order to provide additional support and secure the goal in the fully assembled position as shown in FIG. 1, the assembly 10 further comprises a first connecting leg assembly 18, and a second connecting leg assembly 20. The connecting leg assembly 18 is pivotally connected at a first end 36 to the front frame 14 at a pivot joint 38, and is pivotally connected at a second end 40 to the base frame 12 at a pivot joint 42. Similarly, the connecting leg assembly 20 is pivotally connected at a first end 44 to the front frame 14 at a pivot joint 46, and is pivotally connected at a second end 48 to the base frame 12 at a pivot joint 50.

In one embodiment of the present invention, the first end 36 of connecting leg assembly 18 forms a female leg, and the second end 40 of connecting leg assembly 18 forms a male leg slidably received within the female leg 36. Similarly, the first end 44 of connecting leg assembly 20 forms a female leg, and the second end 48 of connecting leg assembly 20 forms a male leg slidably received within the female leg 44. Each connecting leg assembly 18 and 20 is fabricated such that each female leg 36 and 44, and each corresponding male leg 40 and 48, can be slidably moved relative to the other. When the assembly 10 is in the fully assembled position as shown in FIG. 1, each connecting leg assembly 18 and 20 is in the fully extended position. When the assembly 10 is collapsed, on the other hand, as shown in FIG. 2, each male leg 40 and 48 is slidably removed from the corresponding female leg 36 and 44 to permit collapse of the assembly 10. Of course, the orientation of each connecting leg assembly 18 and 20 could be reversed such that each first end 36 and 44 forms a male leg while each second end 40 and 48 forms the corresponding female leg.

Connecting leg assembly 18 further includes a releasable locking member 22 releaseably connectable between the first end 36 and the second end 40. The releasable locking member 22 can be moved between a locked position and an unlocked position. In the locked position, the releasable locking member 22 extends between the first end 36 and second end 40 such that the first end 36 and second end 40 are fixedly secured relative to each other. In the unlocked position, the releasable locking member 22 is spaced away from the second end 40 such that the first end 36 and the second end 40 can slidably move relative to each other. Similarly, connecting leg assembly 20 further includes a releasable locking member 24 between the first end 44 and the second end 48, and releasable locking member 24 includes all of the characteristics described above in connection with the releasable locking member 22.

In one embodiment of the present invention, the releasable locking members 22 and 24 are each formed by a releasable spring-biased locking pin. Preferably, the locking pin is positioned on the end of the female leg 36 opposite the pivot joint 38, and is receivable through a corresponding aperture formed in the end region of the male leg 40 opposite the pivot joint 42. Accordingly, the connecting leg assembly 18 can be fully extended as shown in FIG. 1, and the releasable locking pin 22 located on the female leg 36 can engage the locking aperture formed in the male leg 40 to fixedly secure the leg assembly 18 in its extended position. Then, by moving the locking pin against the bias of the spring, and out of the aperture in the male leg 40, the male and female legs can be slidably moved relative to each other to fold the sports goal assembly into its collapsed position.

As may be recognized by those skilled in the pertinent art based on the teachings herein, the releasable locking members employed in the sports goal assembly of the present invention may take any of numerous different shapes, configurations, and/or types of such locking members that are currently or later become known for performing the functions of the releaseable locking member described herein. For example, the releaseable locking member may take the form of a cotter pin or other type of fastener slidably receivable through alignable apertures formed through or within the male and female legs or other frame members.

As further shown in FIG. 1, the top frame 16 includes releasable locking members 52 and 54, which can be moved between a locked position and an unlocked position. In the locked position, the releasable locking members 52 and 54 extend between the top frame 16 and the front frame 14 such that the top frame 16 and the front frame 14 are fixedly secured relative to each other. In the unlocked position, the releasable locking members 52 and 54 are spaced away from the front frame 12 such that the top frame 16 and the front frame 12 can pivotally move relative to each other.

In the illustrated embodiment of the present invention, the releasable locking members 52 and 54 are releasable spring-biased locking pins of the type described above. Preferably, the locking pins are positioned on top frame 16 at pivot joints 30 and 32, respectively. Accordingly, top frame 16 can be releaseably locked in an open position with the top frame oriented in a position extending laterally and rearwardly from the front frame 14, as shown in FIG. 1, with the releasable locking members 52 and 54 engaging the front frame 14 at pivot joints 30 and 32 to fixedly secure the top frame 16 in its open position. Then, by moving the locking pin against the bias of the spring, and out of the apertures in the front frame 14, the top frame 16 and the front frame 14 can be slidably moved relative to each other to fold the sports goal assembly into its collapsed position.

As further shown in FIG. 1, each of the base frame 12, front frame 14, and top frame 16 can be fabricated in more than one piece, and in turn each respective piece is fixedly secured to the other to form the assembled frame member. In the illustrated embodiment of the present invention, the base frame 12 is formed from two approximately L-shaped section members 56 and 58, connected to each other by a fastening means 60, such as a bolt and nut. Similarly, front frame 14 is formed from two approximately L-shaped section members 62 and 64, connected to each other by a fastening means 66; and top frame 16 is formed from two approximately L-shaped section members 68 and 70, connected to each other by a fastening means 72. As may be recognized by those skilled in the pertinent art based on the teachings herein, if desired, each frame member can be formed as a single piece, or from more than two pieces. Similarly, the fastening means may take the form of any of numerous different fasteners that are currently or later become known for fastening such tubular or like frame members.

As is shown in FIG. 2, the collapsible sports goal assembly 10 of the present invention can be folded into an approximately flat, collapsed condition. As can be seen, in the flat, collapsed condition, base frame 12 and front frame 14 are folded onto each other, and top frame 16 is oriented approximately parallel to base frame 12 and front frame 14. In addition, the male legs 40 and 48 are slidably removed from the female legs 38 and 44 and are folded against the other. If desired, the front frame 14 may include apertures or like means for receiving the releaseable locking members 52 and 54 in the collapsed position to releaseably secure the top frame 16 relative to the front frame 14 in the collapsed position. One advantage of this configuration is that it facilitates usage of the top frame 16 as a handle to carry or transport the collapsed goal assembly.

Figure 3:
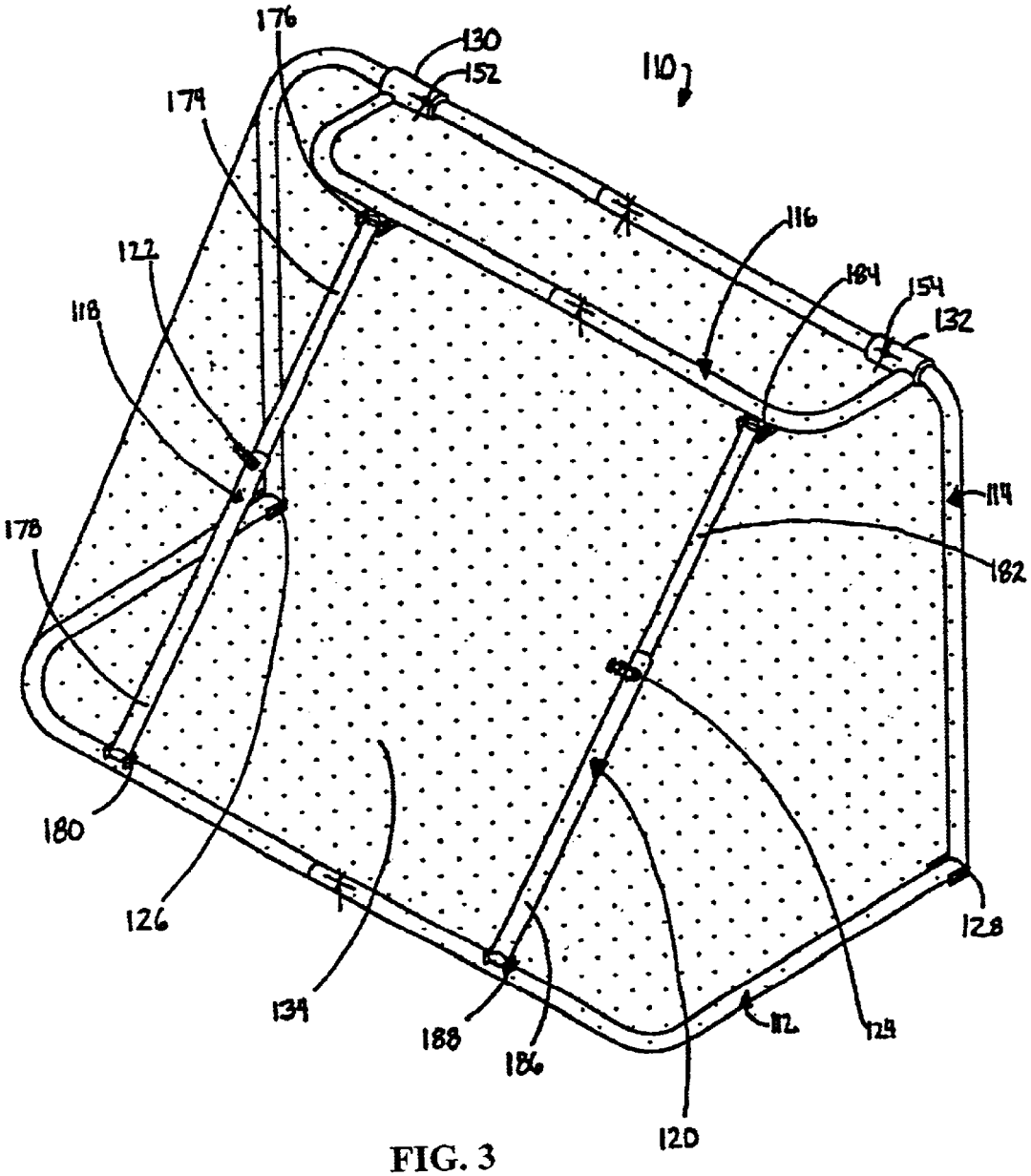
FIG. 3 is a top rear isometric view of a second embodiment of a collapsible sports goal assembly of the present invention in an open condition.
Figure 4:
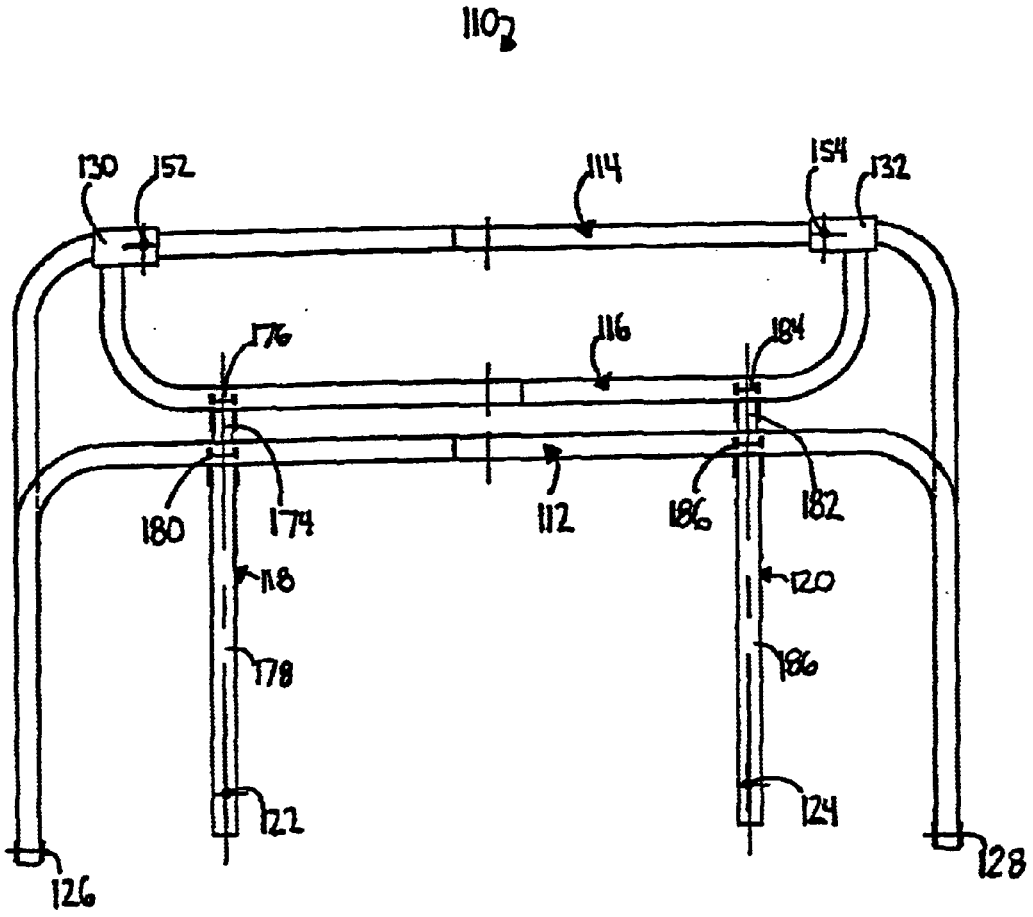
FIG. 4 is a rear elevational view of the collapsible sports goal assembly of FIG. 3 in a closed condition.
Figure 5:
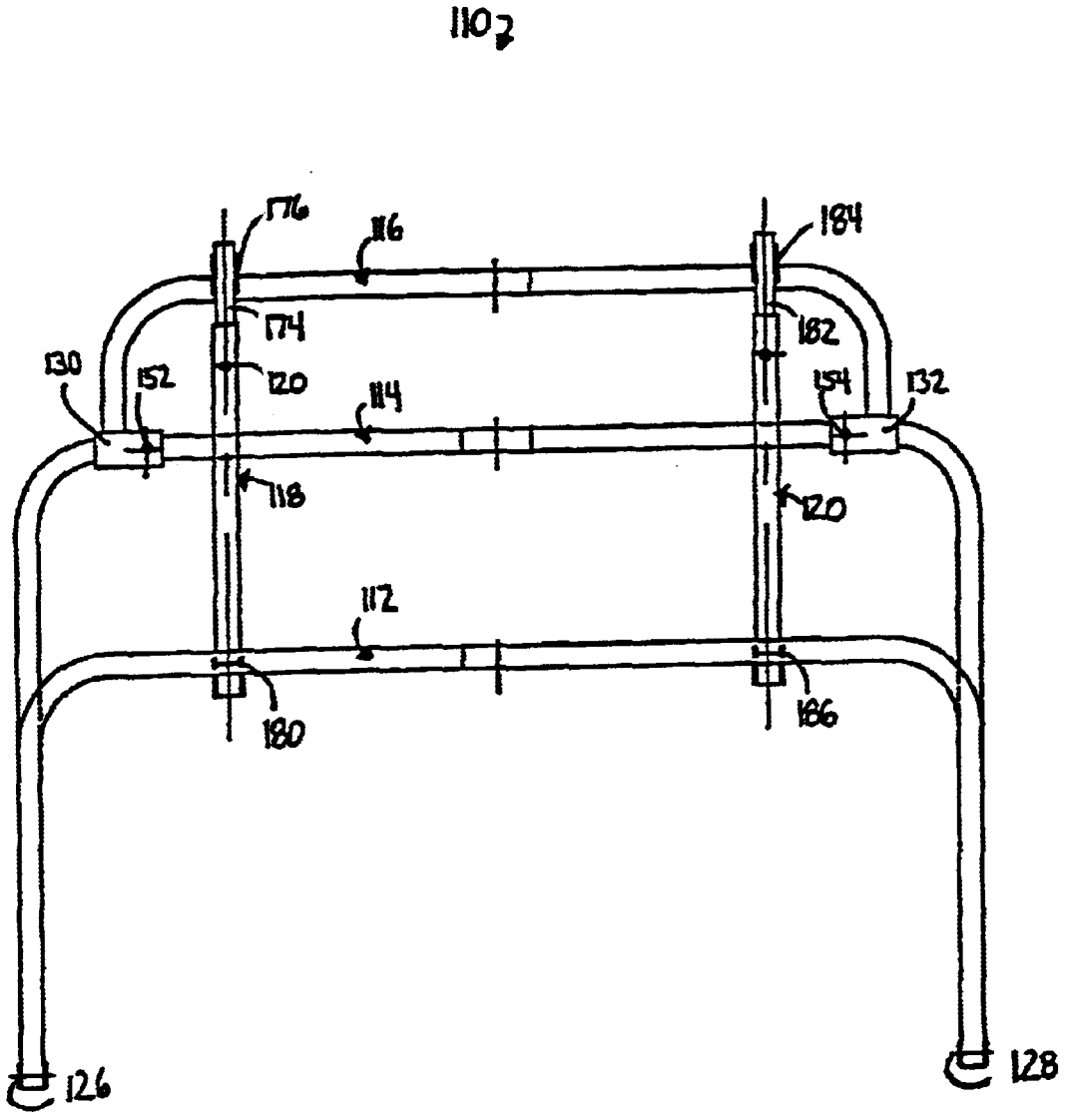
FIG. 5 is a rear elevational view of the collapsible sports goal frame of FIG. 3 in a closed condition.

Turning to FIGS. 3 through 5, another embodiment of a collapsible sports goal assembly of the present invention is indicated generally by the reference numeral 110. The collapsible sports goal assembly 110 is essentially the same as the collapsible sports goal assembly 10 described above with reference to FIGS. 1 and 2, and therefore like reference numerals preceded by the numeral "1" are used to indicate like elements. As can be seen, a primary difference of the collapsible sports goal assembly 110 is that the leg assemblies 118 and 120 are pivotally connected between the third leg of the base frame 112 and the third leg of the top frame 116.

As further shown in FIG. 3, the second end 178 of the connecting leg assembly 118 forms a female leg, and the first end 174 of connecting leg assembly 118 forms a male leg slidably received within the female leg 178. Similarly, the second end 186 of the connecting leg assembly 120 forms a female leg, and the first end 182 of connecting leg assembly 120 forms a male leg slidably received within the female leg 186. Each connecting leg assembly 118 and 120 is fabricated such that each female leg 178 and 186, and each corresponding male leg 174 and 182, can be slidably moved relative to the other. When the assembly 110 is in the fully assembled position as shown in FIG. 3, each connecting leg assembly 118 and 120 is in the fully extended position. When the assembly 110 is collapsed, on the other hand, as shown in FIG. 4, each male leg 174 and 182 is slidably removed from the corresponding female leg 178 and 186 to permit collapse of the assembly 110.

The embodiment shown in FIG. 3 provides two alternative constructions to the embodiment shown in FIG. 1. First, connecting leg assemblies 118 and 120 are connected at a first end 174 and 182 to the top frame 116 instead of the front frame 114. Second, connecting leg assemblies 118 and 120 are oriented such that each first end 174 and 182 forms a male leg and each second end 178 and 186 forms the corresponding female leg, which is a reverse orientation in comparison to the orientation of the legs shown in FIG. 1. Connecting leg assemblies 118 and 120 further include respective releasable locking members 122 and 124 as described above in connection with the embodiment shown in FIG. 1.

As is shown in FIG. 4, the collapsible sports goal assembly 110 can be folded to thereby place the assembly in an approximately flat, collapsed condition. Releasable locking members 152 and 154, and releasable locking members 122 and 124 are all in the open position such that the respective assembly members can move relative to each other. In the flat, collapsed condition, base frame 112 and front frame 114 are folded onto each other. Top frame 116 is oriented approximately parallel to base frame 112 and front frame 114, and positioned between base frame 112 and front frame 114. Accordingly, male legs 174 and 182 are slidably removed from the corresponding female legs 178 and 186 of connecting leg assemblies 118 and 120. Alternatively, and as shown in FIG. 5, top frame 116 can be oriented approximately parallel to base frame 112 and front frame 114, and positioned outwardly such that front frame 114 is between base frame 112 and top frame 116. In this position, top frame 116 can be utilized as a handle to carry assembly 110 in the flat, collapsed position. The top frame 116 further includes releasable locking members 152 and 154, which can be moved between a locked position and an unlocked position, as described above in connection with the releaseable locking members 52 and 54 of the embodiment shown in FIG. 1.

Figure 6:
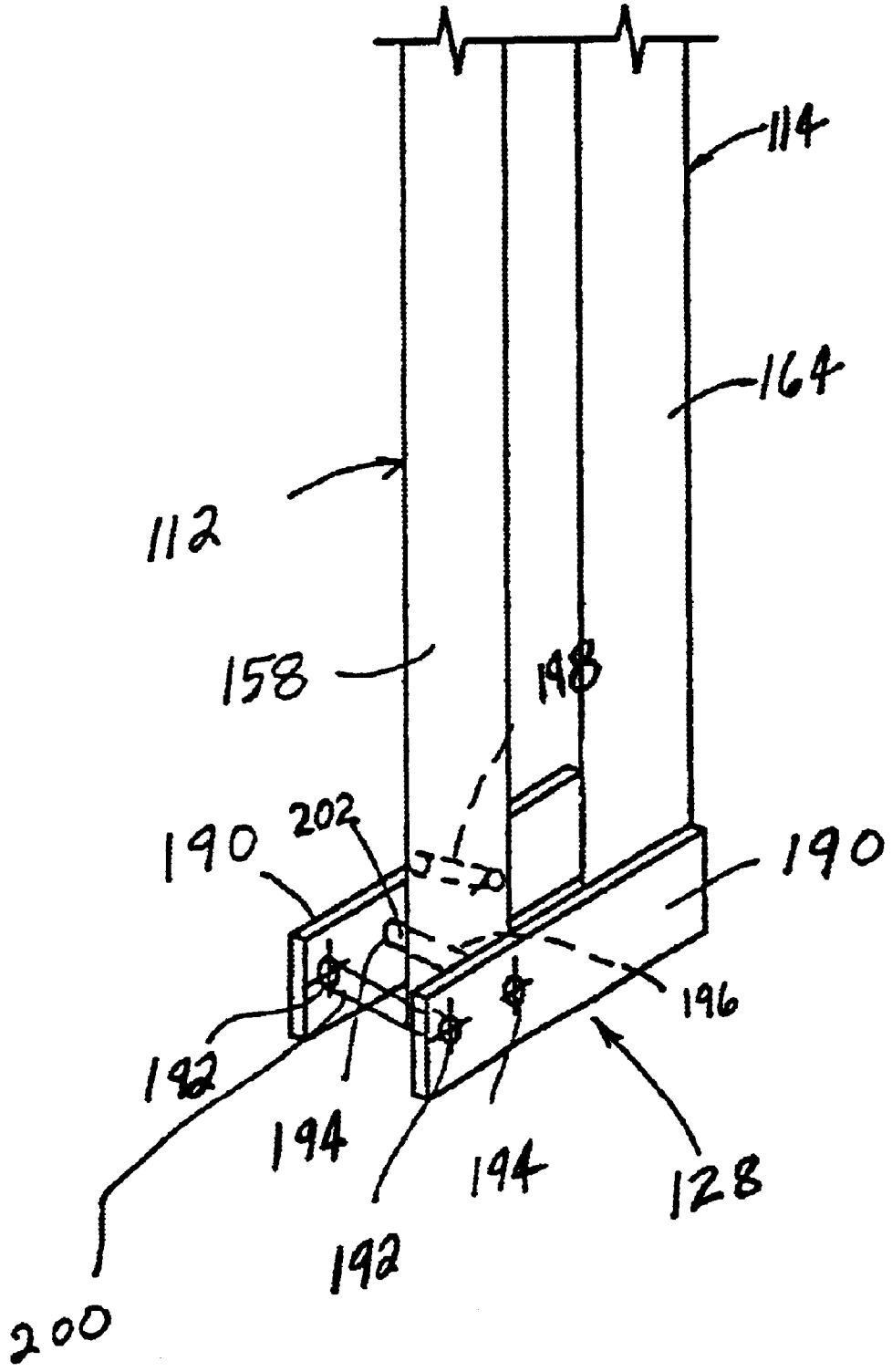
FIG. 6 is an isometric view of a pivot joint of the collapsible sports goal assembly of the present invention.

As shown in FIG. 6, a typical pivot joint 128 includes a pair of supports 190 laterally spaced relative to each other on opposite sides of the end portion of the section 164 of the front frame, and fixedly secured to the front frame, such as by welding. Each support defines at the end opposite the front frame 114 a first aperture 192, and a second aperture 194 spaced inwardly relative to the first aperture. As can be seen, the first apertures 192 are aligned with each other, and the second apertures 194 are aligned with each other. As shown in phantom, the base frame 112 defines a first elongated aperture 196 extending through a respective end thereof, and a second aperture 198 laterally spaced inwardly relative to the first aperture 196. The pivot joint further includes a first releasable locking pin 200 releasably receivable through the first apertures 192 and 198, and a second locking pin 202 received through the second apertures 194 and 196. As shown in FIG. 6, in the collapsed position, the first locking pin 200 is removed from the base frame to allow the base frame to be pivoted toward the front frame into the substantially flat condition. Then, the locking pin 200 is inserted through the first apertures 192 to retain the pin. In the open position, on the other hand, the base frame 112 is pivoted away from the front frame such that the first aperture 198 of the base frame is aligned with the first apertures 192 of the supports 190, and the first locking pin 200 is slidably received through the first apertures 192 and 198 to releasably secure the base frame in the open position. As may be recognized by those skilled in the pertinent art based on the teachings herein, the pins 200 and 202 may take the form of any of numerous different types of pins or other fasteners or fastening mechanisms for performing the functions described herein. For example, the pins 200 and 202 may be typical cotter pins, or may be spring-biased locking pins mounted to one of the supports 190. In addition, the pin 202 need not be releasable, but rather may be fixedly secured, such as by welding or riveting, to the support plates 190.

The other pivot joint 126 is preferably identical to the pivot joint 128 as shown in FIG. 6 and described above. The pivot joints 176, 180, 184 and 188 for pivotally connecting the leg assemblies to the base and top frames (or the base and front frames, as shown in FIG. 1) also be may substantially similar in construction to the pivot joint 128 of FIG. 6. However, the pivot joints for connecting the leg assemblies each require only one pin for pivotally connecting the frames and legs to each other. In addition, as may be recognized by those skilled in the pertinent art, the pivot joint of FIG. 6 may include only one pin.

Figure 7:
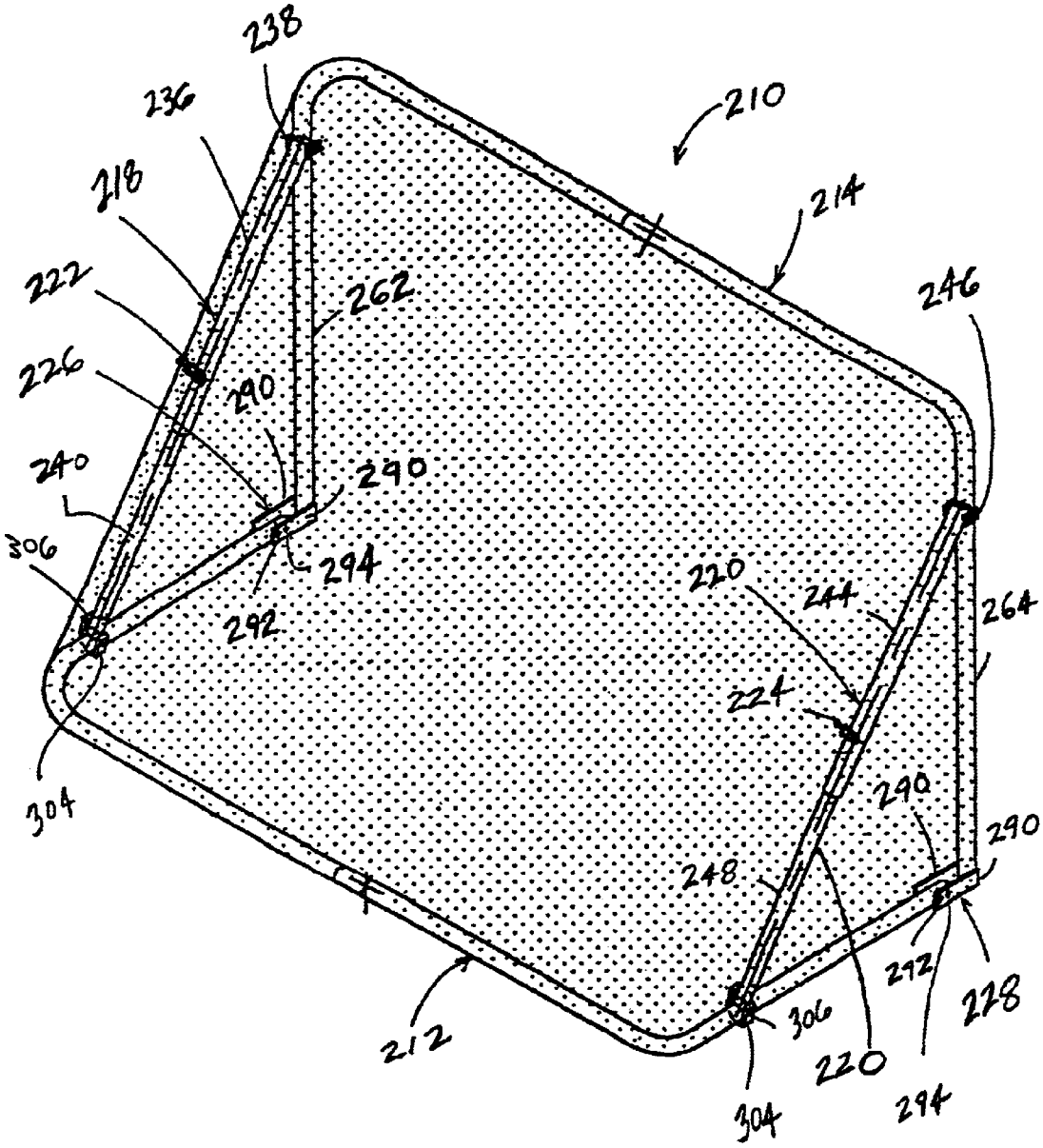
FIG. 7 is a top rear isometric view of a third embodiment of a collapsible sports goal assembly of the present invention in an open condition.
Figure 8:
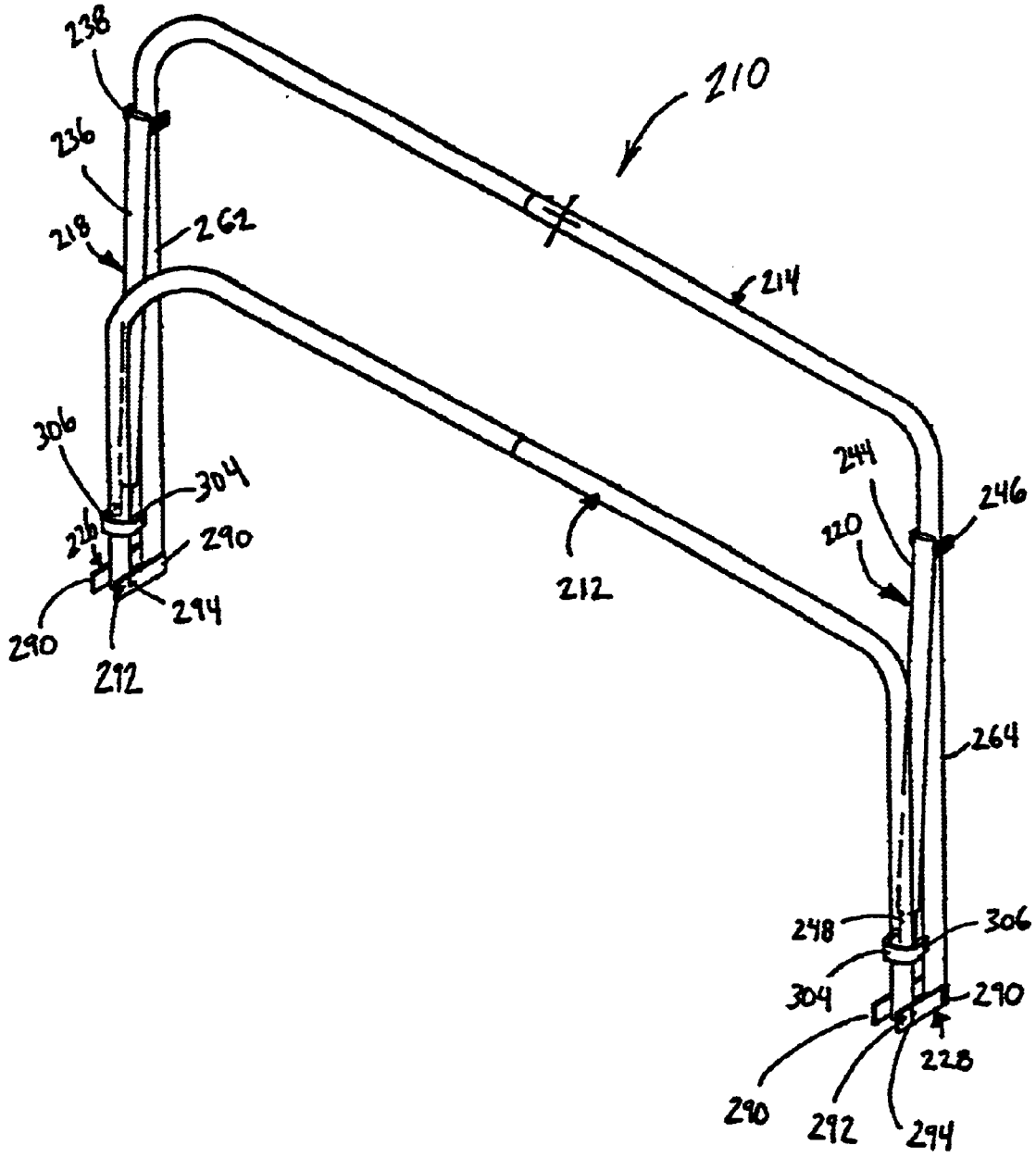
FIG. 8 is a rear elevational view of the collapsible sports goal assembly of FIG. 7 in a closed condition.
Figure 9:
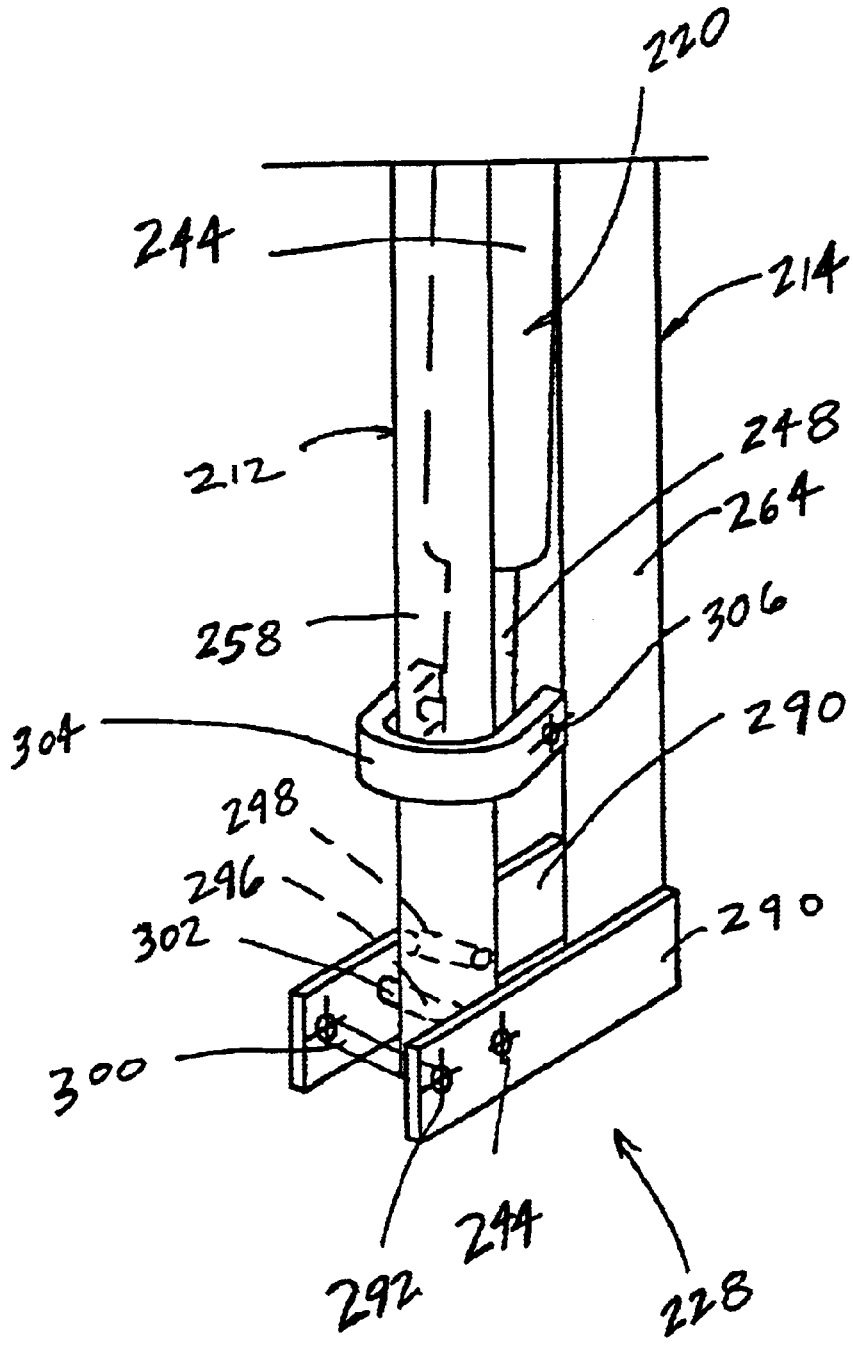
FIG. 9 is an isometric view of a slide collar of the collapsible sports goal assembly of the present invention.

Turning to FIGS. 7–9, another embodiment of the collapsible sports goal assembly of the present invention is indicated generally by the reference numeral 210. The sports goal assembly is substantially similar to the sports goal assemblies 10 and 110 described above, and therefore like reference numerals preceded by the numeral "2", or preceded by the numerals "2" or "3" instead of the numeral "1", are used to indicate like elements. A primary difference of the sports goal assembly 210 is that it does not include a top frame, and further includes means for allowing each connecting leg assembly to slidably move relative to one of the front and base frames.

As shown typically in FIG. 9, each connecting leg assembly includes at one end an approximately u-shaped slide collar 304 received over a respective leg of the base frame 212 and secured by a pin 306 in order to allow the leg assembly to slide along the respective leg of the base frame 212 upon moving the assembly between the open and collapsed positions. In order to collapse the sports goal assembly 210, the releasable locking pins 222 and 224 of the leg assemblies are released to allow the male legs to telescope inwardly within the female legs, and the first pins 292 of the pivot joints 226 and 228 are similarly released to allow the base frame 212 and front frame 214 to be folded onto each other. Thus, as the base frame 212 and/or front frame 214 is folded toward the other, the slide collars 304 slide inwardly over the respective legs of the base frame toward the pivot joints 226 and 228, and simultaneously, the male legs 240 and 248 telescope inwardly within the female legs 236 and 244, respectively, to shorten the overall length of each leg assembly and thereby allow the sports goal to be folded into the collapsed condition. Then, in order to open the goal assembly, the reverse occurs. Once in the fully open position, the releasable locking members 222 and 224 are engaged to releasably lock the leg assemblies in the fully extended (or open) positions. In addition, the first pins 300 are releasably received through the first apertures 292 to further secure the base and front frames in the open positions.

Figure 10:
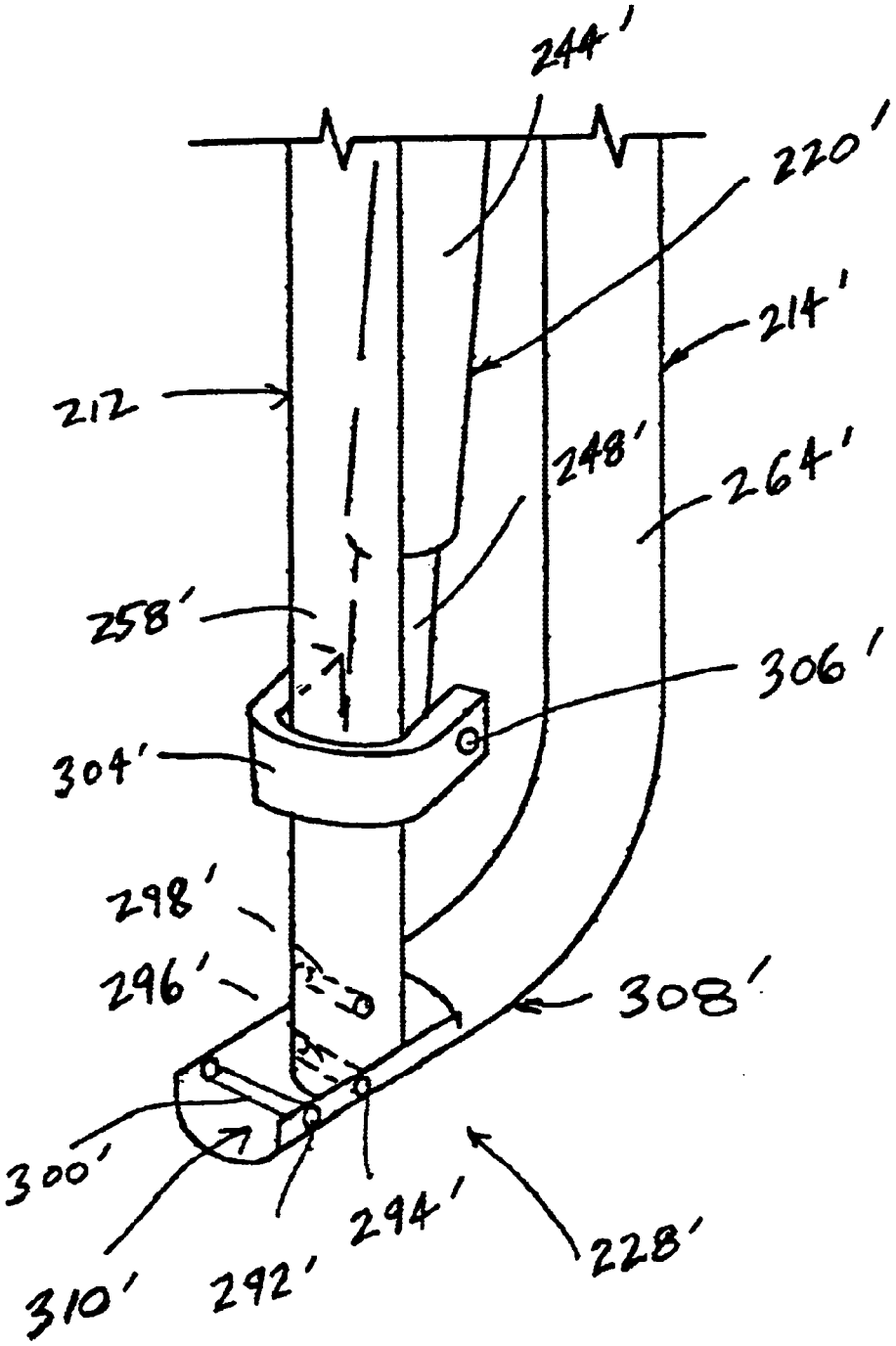
FIG. 10 is an isometric view of another embodiment of the pivot joint and front frame of the collapsible sports goal assembly of the present invention.

In FIG. 10, an alternative construction of the front frame 214' includes end portions 308' (only one shown) that curve inwardly, and each end portion defines a mounting recess 310' having an elongated axis approximately perpendicular to the axis of the respective leg of the front frame. As shown typically in FIG. 10, each end of the base frame 212 is received within a respective mounting recess 310' of the front frame, and is pivotally connected to the front frame by the respective pin 296'. Accordingly, one advantage of this alternative construction is that it eliminates the need for the supports 290, and thereby may simplify construction of the pivot joints 226' and 228'.

Figure 11:
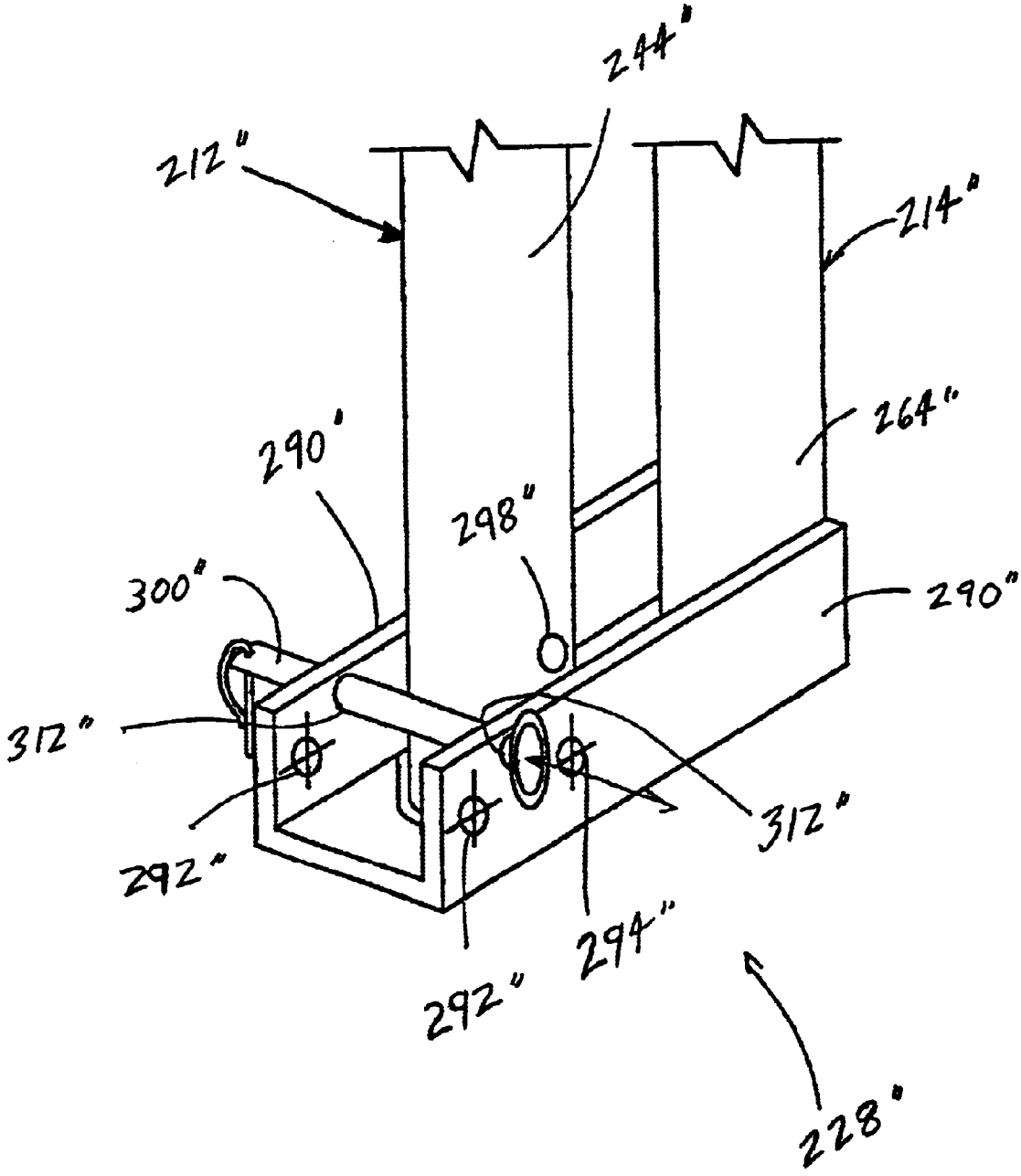
FIG. 11 is an isometric view of another embodiment of a pivot joint of the collapsible sports goal assembly of the present invention.

In FIG. 11, another alternative construction of the pivot joint 228" includes supports 290" formed by an approximately u-shaped channel member, and the supports 290" further define third apertures 312" aligned with each other and spaced above and between the first and second apertures 292" and 294", respectively. Accordingly, as shown typically in FIG. 11, in the closed or collapsed position, the first releasable locking pin 300" can be moved from the first apertures 292" to the third apertures 300", as shown, to prevent pivotal movement of the base frame 212 and thereby releasably lock the base frame in the collapsed position. As can be seen, in the illustrated embodiment, and as described above, the releasable locking pin 300" is in the form of a cotter pin movable into and out of the third apertures as indicated by the arrows in the drawing.

Figure 12:
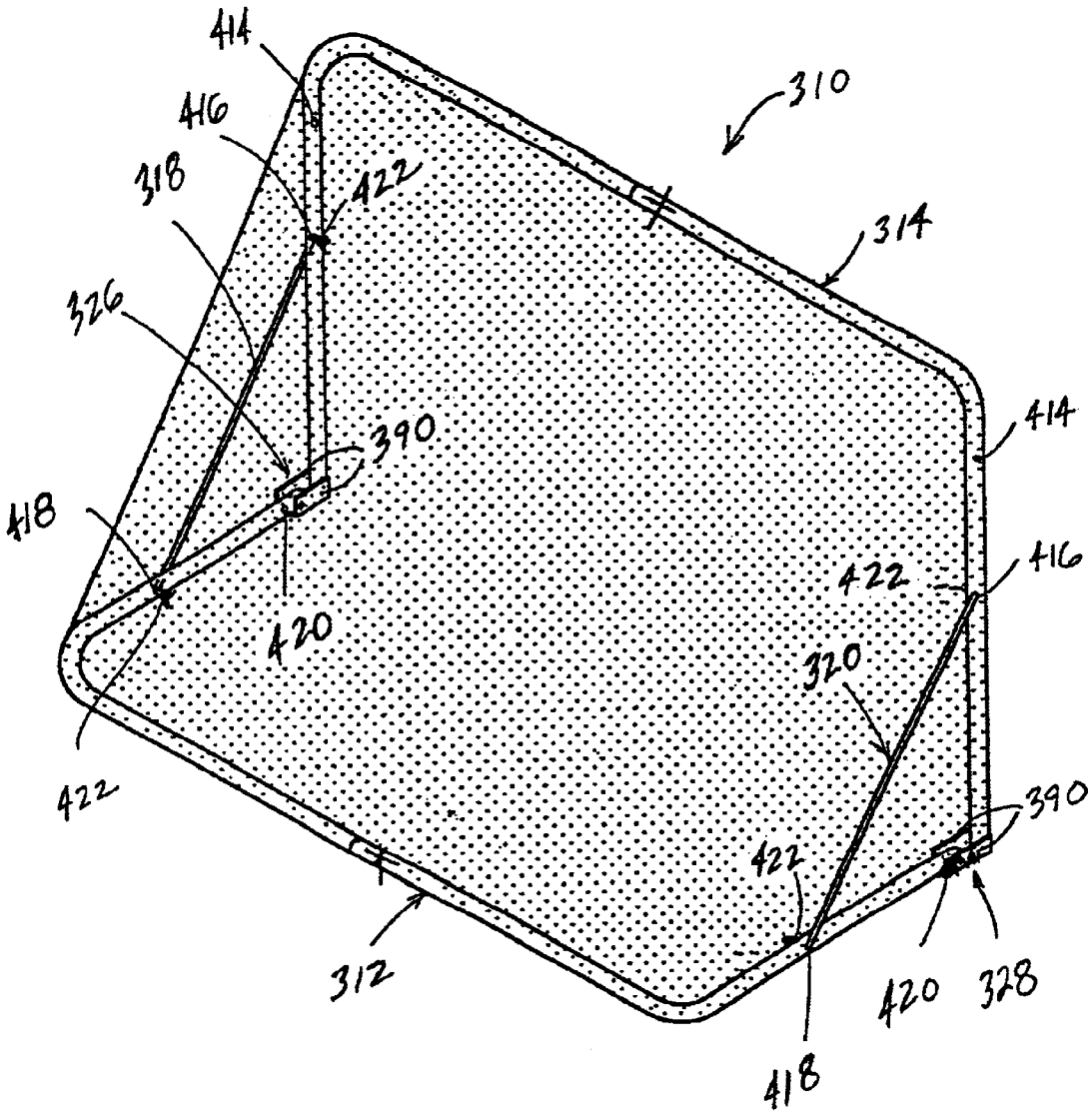
FIG. 12 is a top rear isometric view of a fourth embodiment of a collapsible sports goal assembly of the present invention in an open condition.
Figure 13:
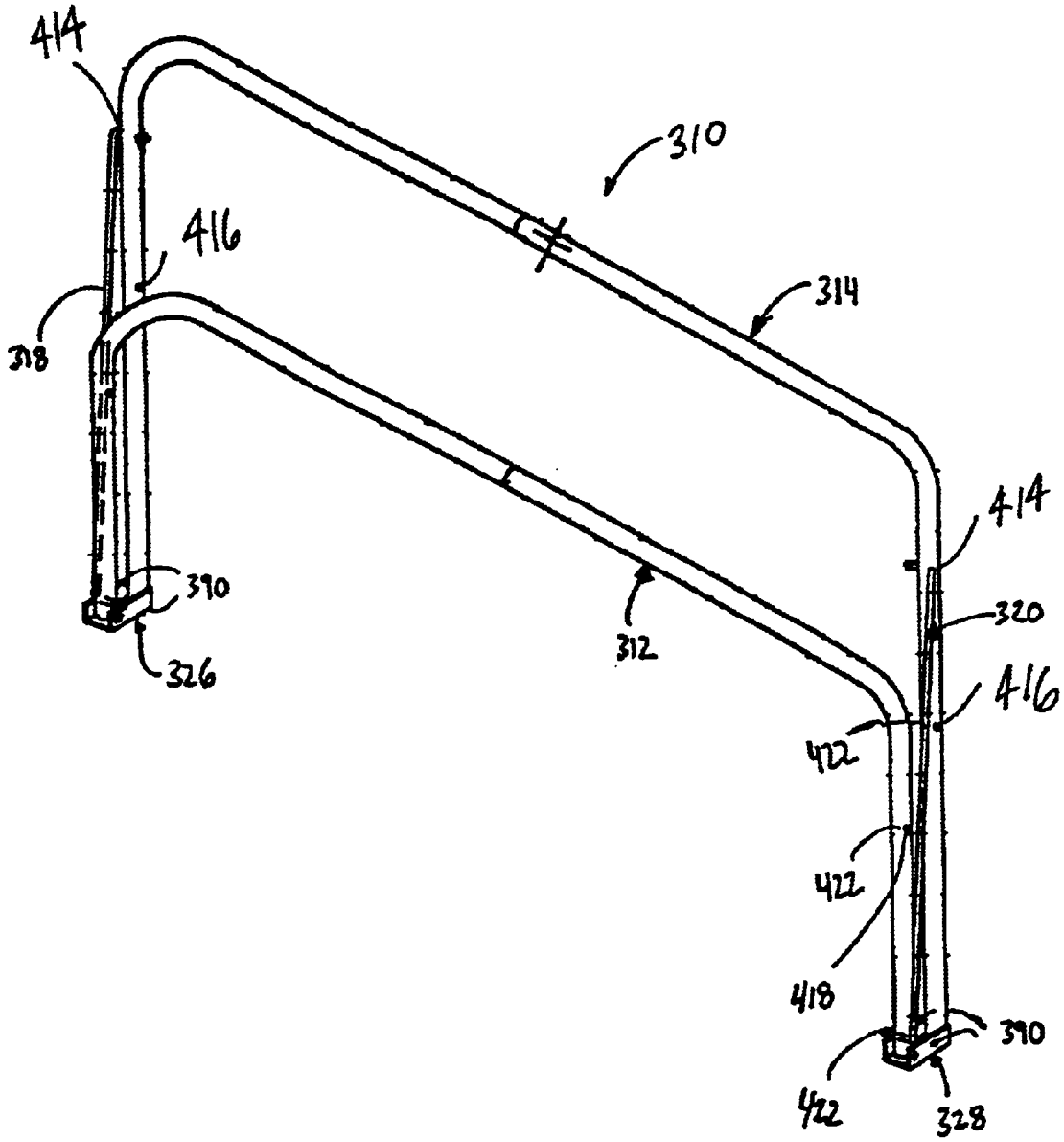
FIG. 13 is a rear isometric view of the collapsible sports goal assembly of FIG. 12 in a closed condition.
Figure 14:
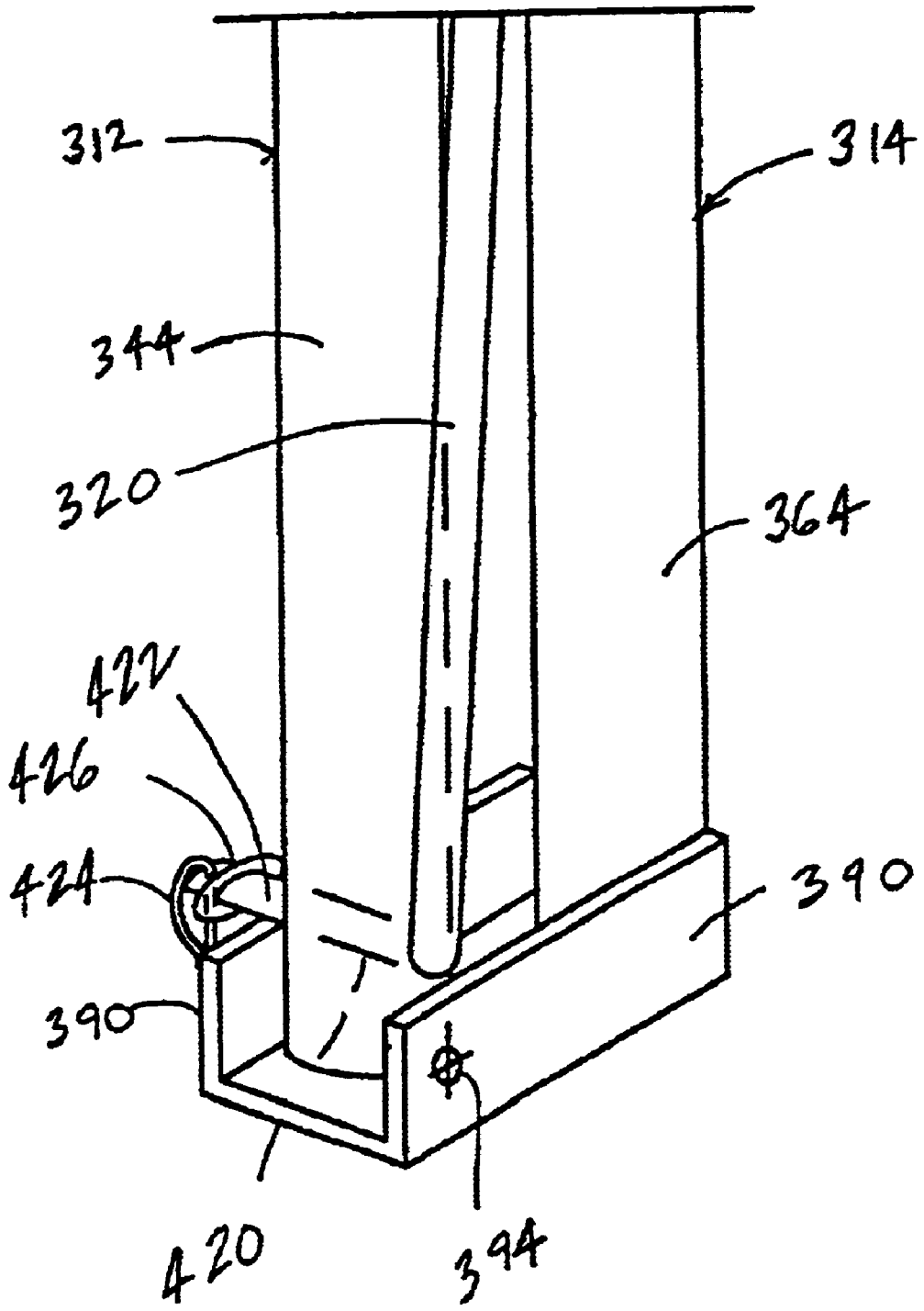
FIG. 14 is an isometric view of another embodiment of a pivot joint of the collapsible sports goal assembly of the present invention.

Turning to FIGS. 12–14, another embodiment of the collapsible sports goal assembly of the present invention is indicated generally by the reference numeral 310. The sports goal assembly 310 is substantially similar to the sports goal assemblies described above, and therefore like reference numerals preceded by the numerals "3" or "4" are used to indicate like elements. A primary difference of the sports goal assembly 310 is that the connecting leg assemblies are not telescopic. Rather, as can be seen, each connecting leg is a single piece, having ends that can be releasably secured to the front and base frames to move the frames between the open and collapsed positions.

As shown in FIGS. 12 and 13, the side legs (or first and second legs) of the front frame 314 each defines a first mounting aperture 414 for receiving the end of the respective leg in the folded or closed position, as shown in FIG. 13, and a second mounting aperture 416 spaced below the first mounting aperture for receiving the end of the respective leg in the open position, as shown in FIG. 12. Similarly, the side legs (or first and second legs) of the base frame 312 each defines a first mounting aperture 418 for receiving the end of the respective leg in the open position, and a second mounting aperture 420 for receiving the end of the respective leg in the folded or collapsed position. As shown typically in FIG. 14, the ends of each leg 318 and 320 are bent inwardly at approximately 90° relative to the main portion of the leg to define mounting portions 422 at the ends of each leg. As shown best in FIG. 14, each mounting portion 422 of each leg includes a cotter pin 424 releasably secured thereto, and an associated washer 426 spaced inwardly relative to the cotter pin.

As may be recognized by those skilled in the pertinent art, the embodiments of FIGS. 6–14 may each include a top frame in the same manner as the embodiment of FIG. 1 in order to achieve the functional advantages of the top frame.

Figure 15:
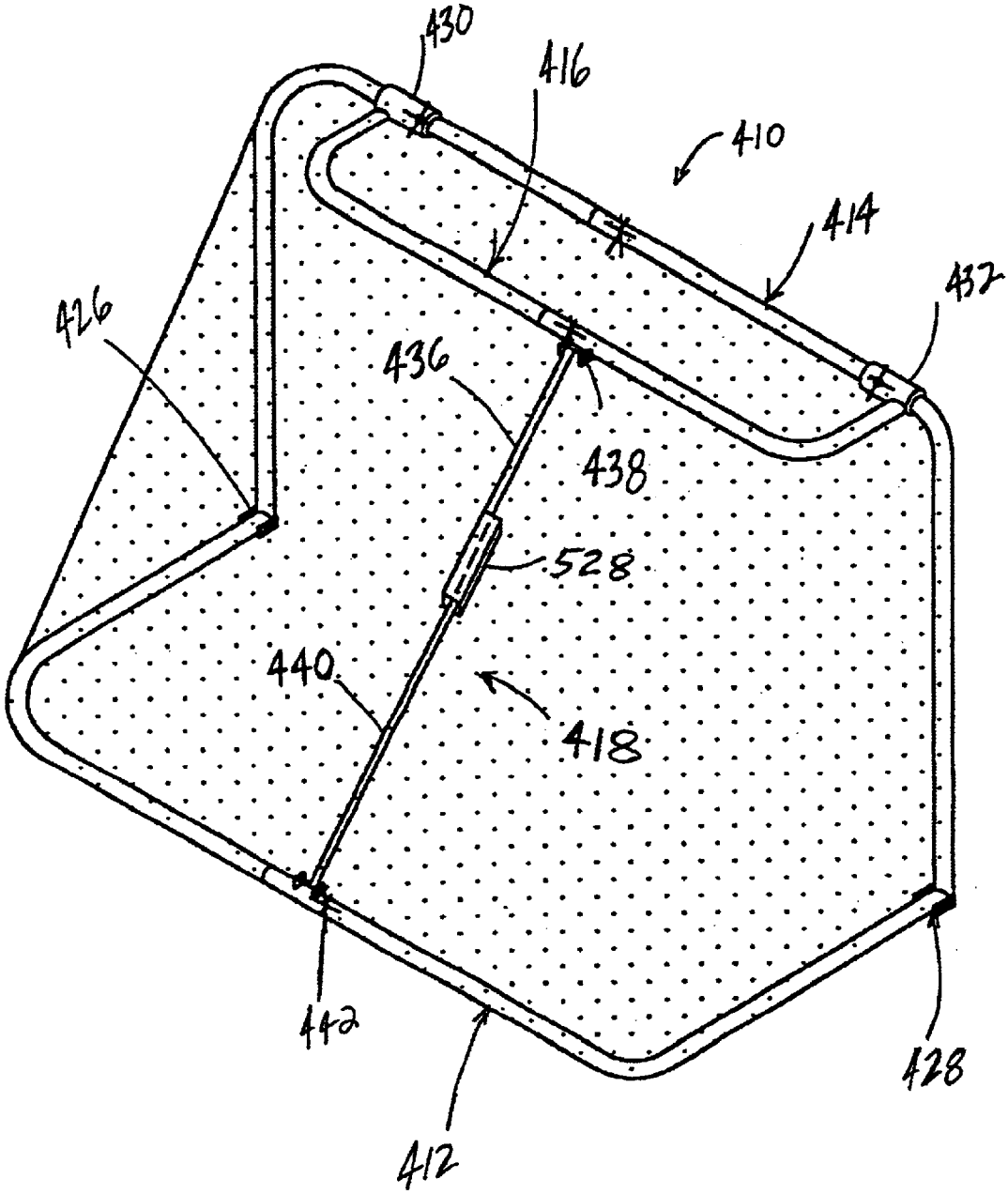
FIGS. 15 and 16 are top rear isometric views of a fifth embodiment of a collapsible sports goal assembly of the present invention in an open condition.
Figure 16:
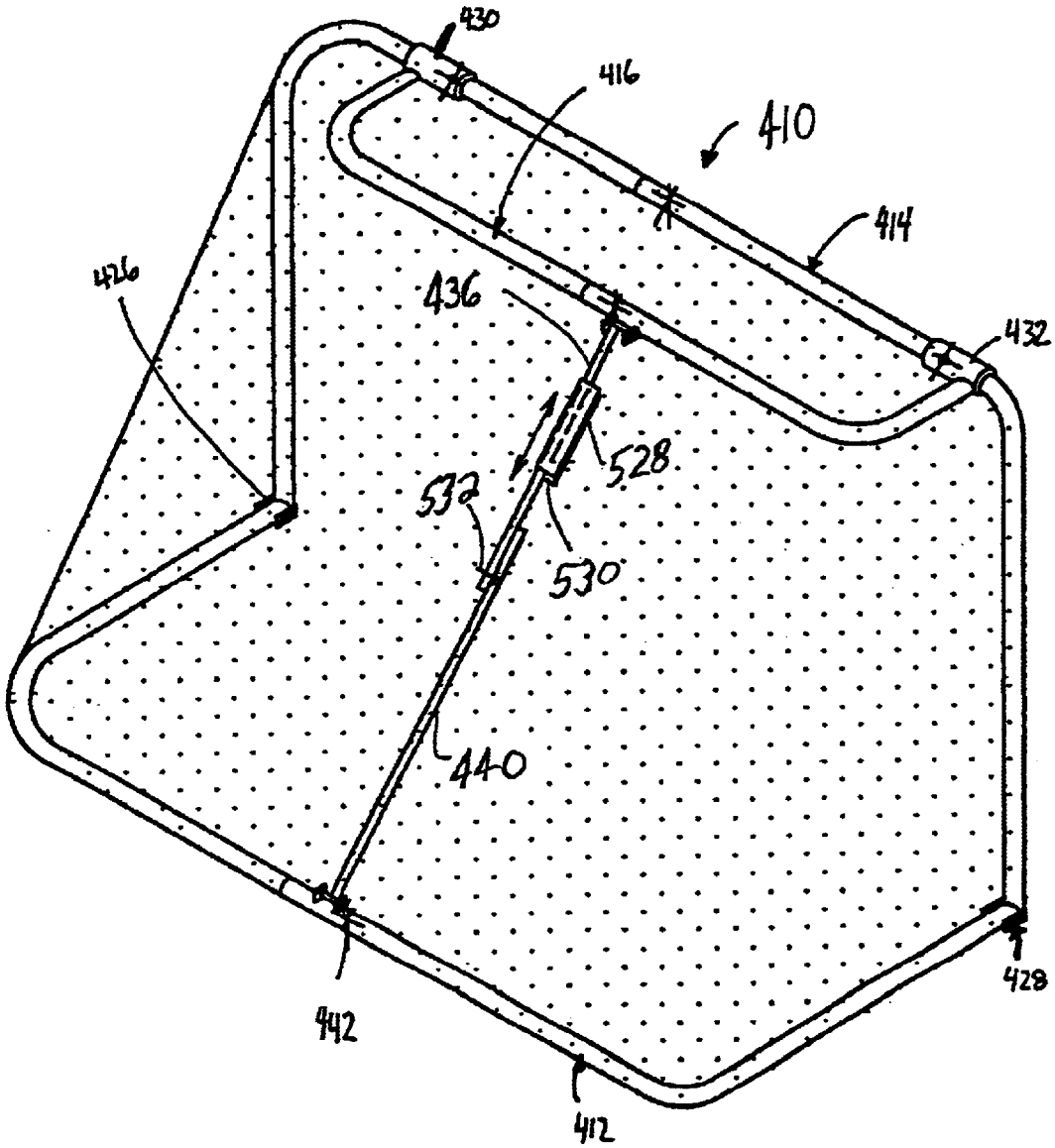
Figure 17:
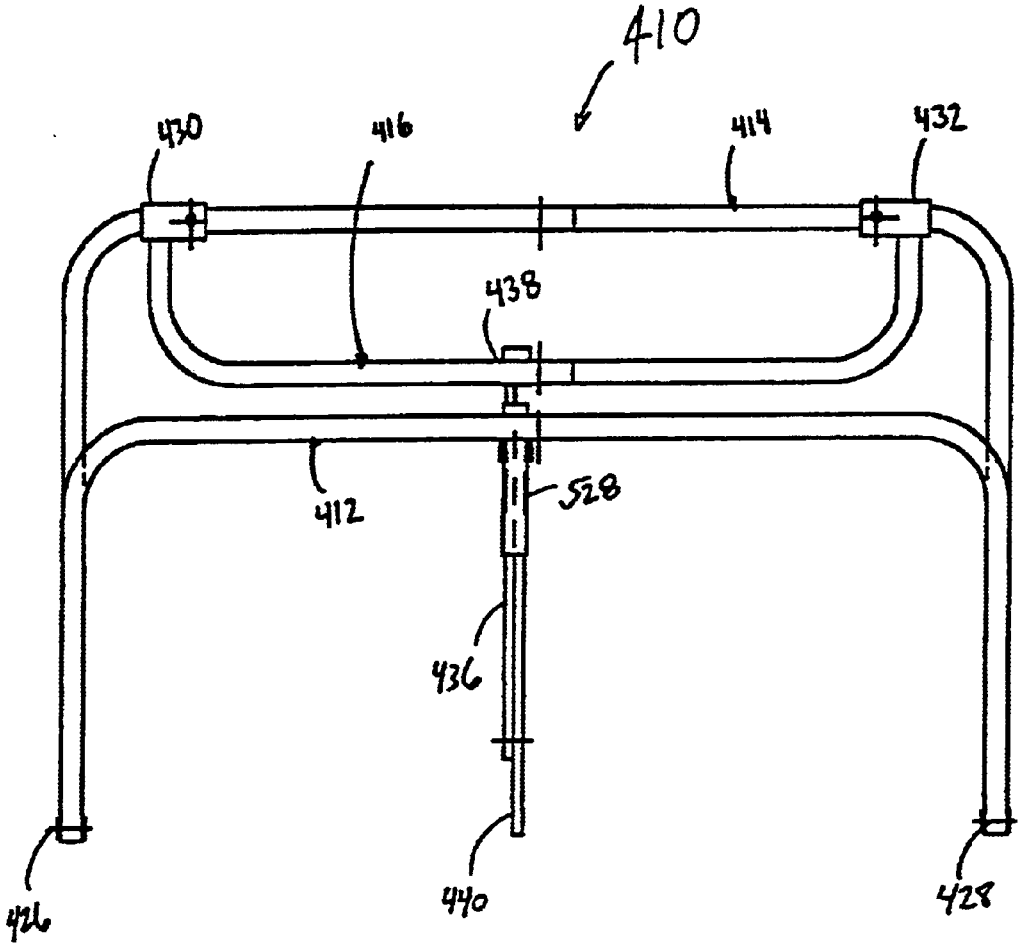
FIG. 17 is a rear elevational view of the collapsible sports goal assembly of FIGS. 15 and 16 in a closed condition.

In FIGS. 15–17, another embodiment of the collapsible sports goal assembly of the present invention is indicated generally by the reference numeral 410. The sports goal assembly 410 is substantially similar to the sports goal assemblies described above, and therefore like reference numerals preceded by the numerals "4" or "5" are used to indicate like elements. A primary difference of the sports goal assembly 410 is that it includes only a single leg assembly 418 pivotally connected between a central region of the base frame 412 and a central region of the top frame 416. In addition, the leg assembly does not include male legs slidably received within female legs as described above. Rather, each leg 436 and 440 is slidably received on one end through a mounting sleeve 528. As shown in FIG. 16, the mounting sleeve 528 defines one or more elongated apertures 530 formed therethrough for slidably receiving the legs 436 and 440. A stop 532 is fixedly mounted on the free end of the leg 436 to retain the mounting sleeve on the leg. In the illustrated embodiment, the interior surfaces of the mounting sleeve 528 frictionally engage the ends of the legs 436 and 440 to releasably secure the legs, and thus the sports goal frame in the open position. Then, to collapse the frame, the mounting sleeve 528 is moved upwardly along the leg 436, as indicated by the arrows in FIG. 16, with sufficient force to overcome the frictional engagement and thereby release the legs and allow the frame to be folded, as shown in FIG. 17.

The mounting sleeve may take any of numerous different shapes or configurations, or may be replaced by any of numerous other fastening mechanisms for performing the functions described herein. For example, one of the legs may instead include a clip on end for releasably connecting the legs together in the open position.

As may be recognized by those skilled in the pertinent art based on the teachings herein, numerous changes and modifications may be made to the above-described and other embodiments of the present invention without departing from its scope as defined in the appended claims. For example, the frames and leg assemblies can be made of any of numerous different materials, including, for example, metal and/or plastic, and can define any of numerous different cross-sectional shapes and configurations, or other shapes and configurations. Similarly, the sports goal assemblies of the present invention can include one or more leg assemblies connected either between the base and front frames, or between the base and top frames. In addition, the locking members and pivot joints can be any of numerous different mechanisms or devices which are currently known, or later become known for performing one or more of the functions of either of these components described herein. Accordingly, this detailed description of preferred embodiments is to be taken in an illustrative, as opposed to a limiting sense.

What is claimed is:

1. A collapsible sports goal assembly, comprising:

a base frame having a first and a second end, wherein each end of the base frame defines a first throughhole and a second throughhole;

a pair of supports, each support having a front end and a base end, each base end defining a first axially aligned pair of apertures and a second axially aligned pair of apertures, the first pair of apertures being laterally spaced relative to the second pair of apertures;

a front frame defining an opening, the front end of each support being fixedly coupled to the front frame;

a pair of hinge members receivable through the first pair of apertures and the first throughhole, respectively, thereby pivotally coupling the base frame to the supports such that, in the collapsed position, the base frame folds onto the front frame;

a pair of locking members receivable through the second support apertures and the second throughhole, respectively, thereby locking the base frame such that, in the play position, the base frame is approximately perpendicular with respect to the front frame; and a net attached to the base frame and the front frame for retaining objects passing through the opening.

2. A collapsible sports goal assembly as recited in claim 1 further comprising at least one connecting leg assembly attachable at one end to the base frame and attachable at another end to the front frame.

3. A collapsible sports goal assembly as recited in claim 1, further comprising a top frame pivotally connected to the front frame by pivot joints.

4. A collapsible sports goal assembly as recited in claim 1, wherein each hinge member is a pin and each locking member is a pin.

5. A collapsible sports goal assembly as recited in claim 1 wherein each support is a pair of rectangular plates.

6. A collapsible sports goal assembly as recited in claim 1, wherein each support is a substantially rectangular plate wrapped around and welded to the front frame.

7. A collapsible sports goal assembly, comprising:

a base frame having a first and a second end, wherein each end of the base frame defines first and second base apertures;

a front frame pivotally connected to the base frame;

two pivot joints for pivotally connecting the front frame and the base frame, each pivot joint including (a) a support having opposing sides laterally spaced relative to each other and fixedly secured to each end of the front frame, each side defining a first and second support aperture, the second support aperture being laterally spaced from the first support aperture (b) a hinge member receivable through the first support apertures and the first base aperture thereby pivotally coupling the base frame to the supports, and (c) a locking member receivable through the second support aperture and the second base aperture, in the play position, to lock the base frame with respect to the front frame; and a net draping over the front frame, wherein, in the play position, the base frame and front frame are oriented approximately perpendicular to each other and, in the folded position, the base frame and the front frame fold onto each other to thereby place the sports goal assembly in an approximately flat, collapsed condition.

8. A collapsible sports goal assembly as recited in claim 7, further comprising at least one connecting leg assembly attachable at one end to the base frame and attachable at another end to the front frame.

9. A collapsible sports goal assembly as recited in claim 7, wherein each support is formed by an approximately u-shaped channel member.

10. A collapsible sports goal assembly as recited in claim 7, wherein each support is formed by an approximately u-shaped member.

11. A collapsible sports goal assembly as recited in claim 7, wherein each support further defines a third support aperture for selectively locking the base frame in the folded position.

12. A collapsible sports goal assembly, comprising:

a base having a first and a second end, wherein each end of the base defines a first throughhole and a second throughhole;

a pair of supports, each support having a front end and a base end, each base end defining a first, second and third aligned pair of apertures, each pair of apertures being laterally spaced relative to the other pairs of apertures;

a front defining an opening, the front end of each support being fixedly coupled to the front;

a pair of hinge members receivable through the first pair of apertures and the first throughhole, respectively, thereby pivotally coupling the base to the supports such that, in the collapsed position, the base folds onto the front; and a pair of locking members selectively receivable through (1) the second support apertures and the second throughhole, respectively, thereby locking the base such that, in the play position, the base is approximately perpendicular with respect to the front, and (2) the third support apertures thereby locking the base such that, in the folded position, the base is approximately parallel with respect to the front.

13. A collapsible sports goal assembly as recited in claim 12, further comprising at least one connecting leg assembly attachable at one end to the base and attachable at another end to the front.

14. A collapsible sports goal assembly as recited in claim 12, further comprising a top frame pivotally connected to the front by pivot joints.

15. A collapsible sports goal assembly as recited in claim 12, wherein each hinge member is a pin and each locking member is a pin.

16. A collapsible sports goal assembly as recited in claim 12, wherein each support is a pair of rectangular plates.

17. A collapsible sports goal assembly as recited in claim 12, wherein each support is a substantially rectangular plate wrapped around and welded to the front.

18. A collapsible sports goal assembly as recited in claim 12, further comprising a net attached to the base and the front for retaining objects passing through the opening.

* * * * *